US007819723B2

(12) United States Patent
Nakamura

(10) Patent No.: US 7,819,723 B2
(45) Date of Patent: Oct. 26, 2010

(54) RETAINER RING AND POLISHING MACHINE

(75) Inventor: Yasuhiko Nakamura, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 0 days.

(21) Appl. No.: 12/053,640

(22) Filed: Mar. 24, 2008

(65) Prior Publication Data

US 2008/0233844 A1 Sep. 25, 2008

(30) Foreign Application Priority Data

Mar. 22, 2007 (JP) ..... 2007-074493

(51) Int. Cl.
*B24B 7/22* (2006.01)

(52) U.S. Cl. ..... 451/288; 451/398

(58) Field of Classification Search ..... 451/60, 451/398, 388, 288, 41
See application file for complete search history.

(56) References Cited

U.S. PATENT DOCUMENTS 6,354,927 B1 * 3/2002 Natalicio ..... 451/287
6,390,904 B1 * 5/2002 Gleason et al. ..... 451/286
6,585,850 B1 * 7/2003 Kenji et al. ..... 156/345.12
6,824,458 B2 * 11/2004 Ensinger ..... 451/415
7,044,838 B2 * 5/2006 Maloney et al. ..... 451/41
7,503,837 B2 * 3/2009 Oh et al. ..... 451/285
2005/0277375 A1 * 12/2005 Young ..... 451/442

FOREIGN PATENT DOCUMENTS

JP 11-291162 10/1999

* cited by examiner

*Primary Examiner*—Robert Rose
(74) *Attorney, Agent, or Firm*—Young & Thompson

(57) ABSTRACT

To provide a retainer ring by which an object to be polished can be uniformly polished, and deterioration thereof can be suppressed, and it does not take time to recycle, and a polishing machine having the retainer ring. The retainer ring 1 includes: a first annular portion 11 for surrounding an outer circumferential portion of the object to be polished and made of resin; and a second annular portion 12 provided on the first annular portion 11 and having a mechanical strength higher than that of the first annular portion 11. In rim portions of the first annular portion 11 and the second annular portion 12, a fixing portion 13 for fixing the first annular portion 11 and the second annular portion 12 with mechanical joining is provided. The first annular portion 11 protrudes beyond the fixing portion 13 toward the opposite side of the second annular portion 12.

17 Claims, 10 Drawing Sheets

RETAINER RING AND POLISHING MACHINE

BACKGROUND OF THE INVENTION

1. Field of the Invention

The present invention relates to a retainer ring and a polishing machine having the same.

2. Description of the Related Art

Recently, in the process of production of devices on a semiconductor substrate, a chemical mechanical polishing (hereinafter, called "CMP") method is used to flatten unevenness on surfaces generated during the production process, such as unevenness on surfaces of an interlayer insulating film, by polishing.

In CMP, a polishing machine 100 is generally used, as shown in FIG. 6.

The polishing machine 100 includes a gripping portion 101 for gripping an object to be polished (not shown), a polishing table 103 to which a polishing pad 102 is attached and a chemical supply port 104.

The gripping portion 101 includes a retainer ring 101B (see FIG. 7).

In polishing, the object to be polished is gripped by the gripping portion 101, and a polished surface thereof is pressed against the polishing pad 102 and polished. The retainer ring 101B is used to prevent the object to be polished from flying out of the gripping portion 101 and an outer circumferential portion of the object to be polished from being abnormally polished.

In polishing without use of the retainer ring, a most outer circumferential portion of the object to be polished is subject to the largest contact pressure. At this time, as shown in FIG. 8A, a deformed area A is generated by the effect in the polishing pad 102 across the width of several millimeters from the most outer circumferential portion of the object to be polished 6, resulting in a lowered pressure acting on the outer circumferential portion of the object to be polished 6. As the result, a polishing amount of the outer circumferential portion of the object to be polished 6 is reduced.

Then, using the retainer ring 101B, as shown in FIG. 8B, a surface of the object to be polished 6 in contact with the polishing pad 102 and a surface of the retainer ring 101B in contact with the polishing pad 102 are made at the same height. Further, a width of the retainer ring 101B in contact with the polishing pad 102 is set to be equal to or larger than that of the deformed area A. Moreover, to the retainer ring 101B, a predetermined pressure is applied. This can prevent the deformed area A from extending to the outer circumferential portion of the object to be polished 6, which can prevent a decrease in the polishing amount by which the outer circumferential portion of the object to be polished 6 is polished (abnormal polishing). In addition, in FIGS. 8A and 8B, the symbol "101A" shows an insert pad provided on a reverse surface of the object to be polished.

The contact of the retainer ring 101B with the polishing pad 102 polishes the retainer ring 101B, and impurities spread gradually. Using alloy material such as stainless steel for the retainer ring 101B, metal components spread over the polishing pad 102, which may adversely affect characteristics of devices to be formed on the object to be polished 6. Then, it is thought that rigid plastic is used for the retainer ring 101B. However, its mechanical strength is lower, compared with stainless steel, and the retainer ring is more deformed as the number of objects to be polished that are processed increases.

Then, as shown in FIG. 9, it was proposed that a retainer ring 105 be composed of a ring-shaped resin portion 105A provided on the polishing pad 102 side and a ring-shaped portion 105B of stainless steel or the like having a high mechanical strength (see Japanese Patent Laid-Open No. 11-291162).

SUMMARY

However, the technique disclosed in Japanese Patent Laid-Open No. 11-291162 has the following problems.

As shown in FIG. 10, the resin portion 105A and the ring-shaped portion 105B made of stainless steel or the like of the retainer ring 105 are bonded to each other with an adhesive S. When the resin portion 105A and the ring-shaped portion 105B of stainless steel or the like are fixed with the adhesive S, a bubble H occurs in the inside of the adhesive S in the case of an insufficient amount of the adhesive S or poor deairing. Due to the generated bubble H, a pressure cannot be uniformly applied to the polishing pad 102 by the retainer ring 105, resulting in imbalanced pressure transfer. Accordingly, the deformed area A of the polishing pad 102 extends not only to an area under the retainer ring 105, but to a contact portion with the outer circumferential portion of the object to be polished 6. Thus, the polishing amount of the outer circumferential portion of the object to be polished 6 is made different from that in another portion, and it becomes difficult to uniformly polish the object to be polished 6.

Further, in polishing, a chemical such as acids or alkalis is supplied by the chemical supply port 104, and the chemical may corrode the adhesive S, and the retainer ring 105 may deteriorate.

Further, when a used retainer ring 105 is recycled, a method has been used in which only the resin portion 105A is changed, and the adhesive S is left behind on the side of the ring-shaped portion 105B of stainless steel or the like having a high mechanical strength. Then, it takes time to remove the adhesive S, and it is difficult to easily recycle the retainer ring 105.

The present invention provides a retainer ring for holding an outer circumferential portion of an object to be polished, comprising: a first annular portion for surrounding the outer circumferential portion of the object, and a second annular portion provided on the first annular portion, wherein the second annular portion is fixed to the first annular portion by a mechanical joining.

Further, the present invention provides a polishing machine comprising: a polishing pad for polishing an object, and a gripping portion for gripping the object and bringing the object into contact with the polishing pad, wherein the gripping portion has a retainer ring for holding an outer circumferential portion of the object, and the retainer ring includes: a first annular portion for surrounding the outer circumferential portion of the object and being brought into contact with the polishing pad, and a second annular portion provided on the first annular portion, and wherein the second annular portion is fixed to the first annular portion by a mechanical joining.

According to the present invention, the retainer ring has the fixing portion for fixing the first annular portion and the second annular portion provided in the rim portions of the first annular portion and the second annular portion. Then, the first annular portion protrudes beyond the fixing portion toward the opposite side of the second annular portion. Accordingly, in polishing, the fixing portion is not made in contact with the polishing pad, and only the first annular portion can be brought into contact with the polishing pad. Accordingly, a pressure is uniformly applied to the polishing pad by the retainer ring, and the deformed area of the polishing pad can be prevented from extending to the contact portion of the polishing pad with the outer circumferential portion of the object to be polished. Thus, the polishing amount of the outer circumferential portion of the object to be polished can be prevented from differing from that of another portion, and thereby the object to be polished can be uniformly polished.

Further, the fixing portion is used to fix -the first annular portion and the second annular portion with mechanical joining, and the adhesive does not corrode as conventionally, which can suppress deterioration of the retainer ring. Further, in recycling the retainer ring, it becomes unnecessary to remove the adhesive, and the retainer ring can be easily recycled.

Also, the present invention can provide the retainer ring by which the object to be polished can be uniformly polished, deterioration can be suppressed, and easy recycling is achieved, and the polishing machine including this retainer ring.

DETAILED DESCRIPTION OF THE PREFERRED EMBODIMENTS

Now, embodiments of the present invention will be described with reference to the accompanying drawings.

First Embodiment

Figure 1:
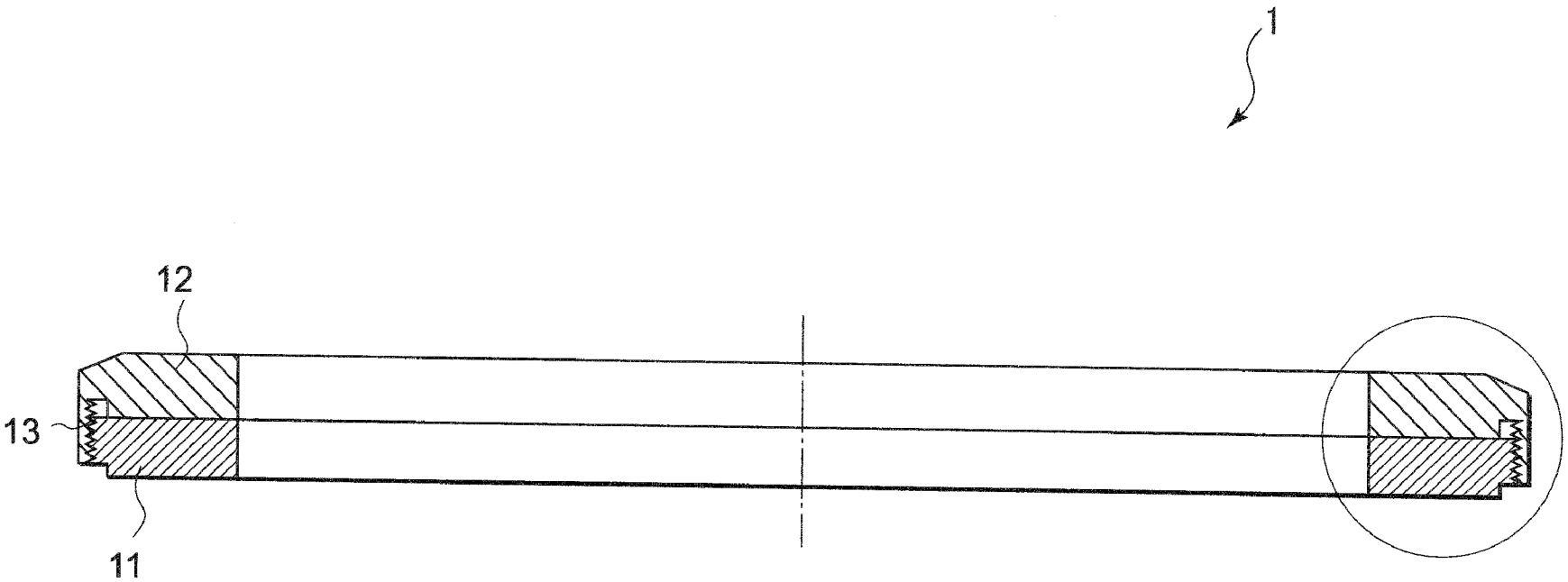
FIG. 1 is a cross-section view of a retainer ring according to a first embodiment of the present invention.
Figure 2:
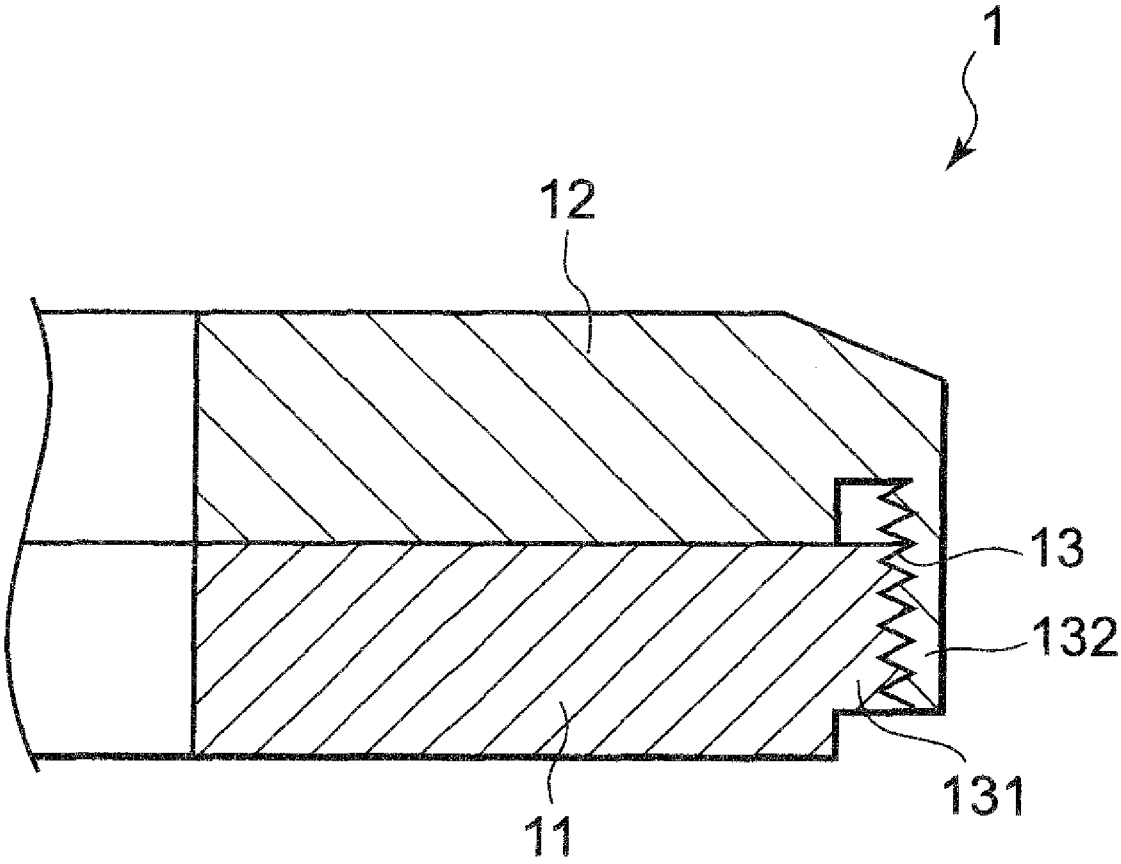
FIG. 2 is an enlarged cross-section view of a main portion of the retainer ring.
Figure 3:
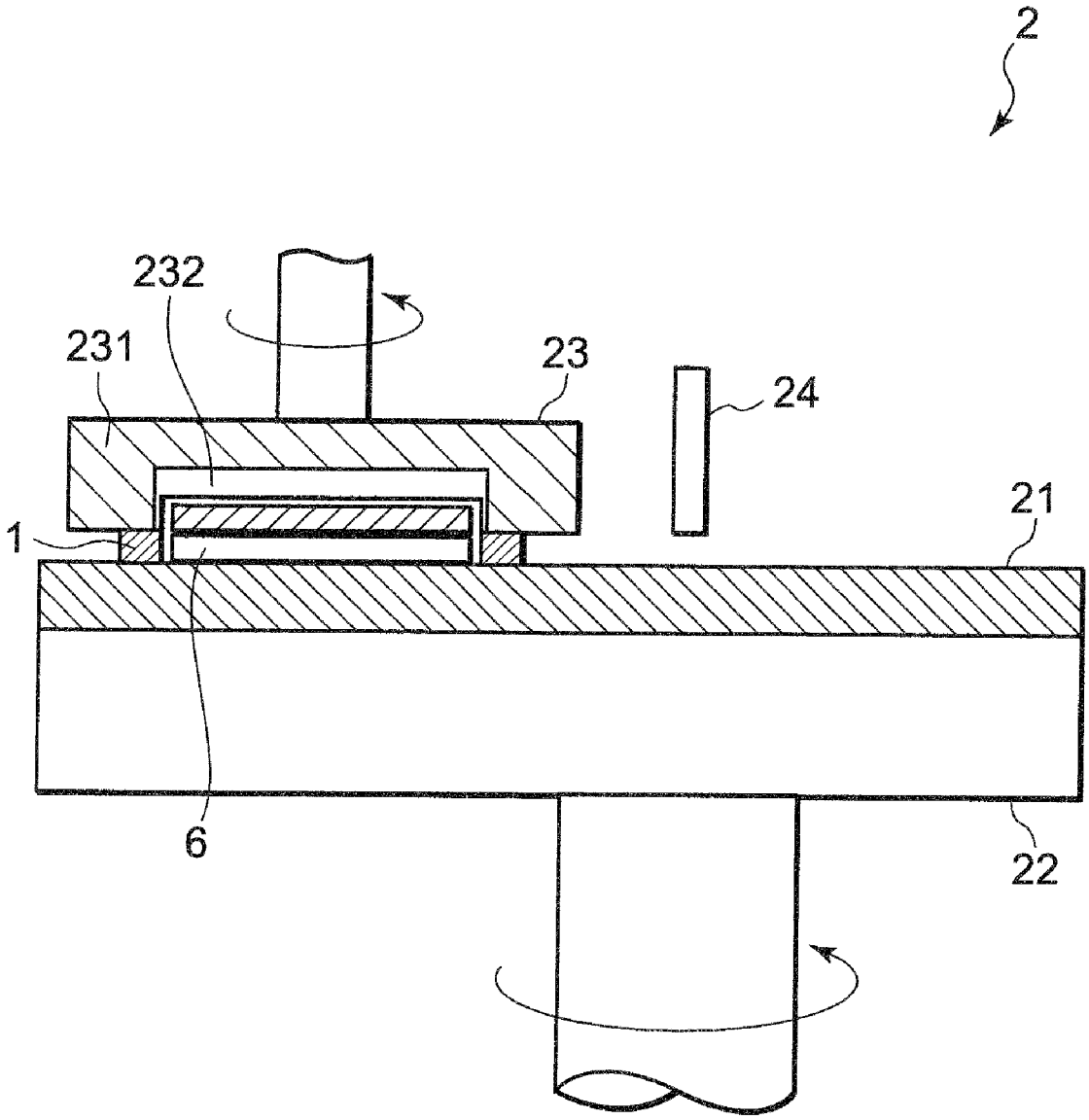
FIG. 3 is a schematic diagram illustrating a polishing machine.

First, referring to FIGS. 1 to 3, a retainer ring of the present embodiment will be schematically described. In addition, in the following description, a like portion as the portion already described will be shown by a like symbol and the description will be omitted.

A retainer ring 1 of the present embodiment holds an outer circumferential portion of an object to be polished 6, and is brought into contact with a polishing pad 21 along with the object to be polished 6. The object to be polished 6 is a circular substrate, for example, a semiconductor wafer. In addition, in a part of a peripheral portion of the circular substrate, a notch for alignment (the portion in which a V-shaped groove is formed in the part of the peripheral portion of the substrate) may be formed.

The retainer ring 1 includes: a first annular portion 11 for surrounding the outer circumferential portion of the object to be polished 6; and a second annular portion 12 provided on the first annular portion 11 and having a mechanical strength higher than that of the first annular portion 11.

In rim portions of the first annular portion 11 and the second annular portion 12, a fixing portion 13 for fixing the first annular portion 11 and the second annular portion 12 with mechanical joining is provided.

The first annular portion 11 protrudes beyond the fixing portion 13 toward the opposite side of the second annular portion 12. That is, a surface of the first annular portion 11 on the polishing pad 21 side protrudes beyond a surface of the fixing portion 13 on the polishing pad 21 side toward the polishing pad 21 side.

Next, the retainer ring 1 will be described in detail.

As shown in FIGS. 1 and 2, the retainer ring 1 includes a first annular portion 11 made of resin, a second annular portion 12 and a fixing portion 13. In addition, FIG. 1 is a cross-section view of the retainer ring 1, and FIG. 2 is an enlarged view of a part surrounded by the circle in FIG. 1.

The first annular portion 11 is formed in an annular shape. In polishing, the object to be polished 6 is fitted into an inner circumferential side of the first annular portion 11 (see FIG. 3).

The first annular portion 11, in polishing the object to be polished 6, for example, a substrate is brought into contact with the polishing pad 21 (see FIG. 3). For the purpose, the first annular portion 11 is preferably formed of a chemically stable member in polishing. Also, the member is preferably a member that will not adversely affect characteristics of devices to be formed on the object to be polished 6 even if the contact causes a part of components of the member constituting the first annular portion 11 to diffuse over the polishing pad. Such first annular portion 11 is, for example, made of resin, and more particularly contains, for example, polyethylene terephthalate resin.

The second annular portion 12 is disposed on the first annular portion 11, and formed in an annular shape. The second annular portion 12 is composed of a member having a mechanical strength higher than that of the first annular portion 11. For example, the second annular portion 12 is made of metal such as stainless steel.

The fixing portion 13 is used to fix the first annular portion 11 and the second annular portion 12 with mechanical joining. The fixing portion 13 includes a male thread portion 131 provided in an outer circumferential portion of the first annular portion 11 and a female thread portion 132 provided in an outer circumferential portion of the second annular portion 12.

The male thread portion 131 is integrally formed with the first annular portion 11, and made of the same resin as the first annular portion 11. On an outer circumferential surface of the male thread portion 131, a screw thread is provided. An upper surface of the male thread portion 131 is situated at the same height as a surface of the first annular portion 11 on the second annular portion 12 side.

Further, a lower surface of the male thread portion 131 (the surface situated on the polishing pad 21 side when being mounted on a polishing machine 2) is situated closer on the second annular portion 12 side than a surface of the first annular portion 11 on the polishing pad 21 side. That is, the first annular portion 11 protrudes beyond the male thread portion 131 toward the opposite side of the second annular portion 12.

The female thread portion 132 is integrally formed with the second annular portion 12, and made of the same material as the second annular portion 12. The female thread portion 132 has a threaded hole formed therein, and on an inner circumferential surface of the threaded hole, a screw thread is provided. An upper surface of the threaded hole is situated higher than a surface of the second annular portion 12 on the first annular portion 11 side. Then, between the upper surface of the male thread portion 131 and the upper surface of the threaded hole of the female thread portion 132, a gap is formed. Such gap formation can prevent the male thread portion 131 from being damaged when the male thread portion 131 is too much pushed into the threaded hole of the female thread portion 132.

Further, a lower surface of the female thread portion 132 (the surface situated on the polishing pad 21 side when being mounted on the polishing machine 2) is situated closer on the second annular portion 12 side than a surface of the first annular portion 11 on the polishing pad 21 side. That is, the first annular portion 11 protrudes beyond the female thread portion 132 toward the opposite side of the second annular portion 12.

The female thread portion 132 and the male thread portion 131 of the fixing portion 13 as configured above are screwed together, and thereby the first annular portion 11 and the second annular portion 12 are fixed and the retainer ring 1 is assembled.

The retainer ring 1 as configured in a way described above, as shown in FIG. 3, is incorporated in a polishing machine 2.

The polishing machine 2 includes a polishing table 22, a gripping portion 23 for gripping the object to be polished 6 and a nozzle 24 for supplying a chemical. The polishing machine 2 is, for example, a CMP apparatus, and polishes an insulating film or a metal film formed on a surface of a semiconductor wafer.

The polishing table 22 is configured to be rotatable, and on a surface of the polishing table 22, a polishing pad 21 is provided. From the nozzle 24, a chemical, for example, slurry is supplied onto a surface of the polishing pad 21. The CMP apparatus polishes the object to be polished 6 using a mechanical effect and a chemical effect due to components in the slurry.

The gripping portion 23 grips the object to be polished 6, and in polishing, brings a polished surface of the object to be polished 6 into contact with the polishing pad 21 and presses it. The gripping portion 23 includes a polishing head 231 and a retainer ring 1 to be disposed under the polishing head 231. The polishing head 231 rotates and swings the object to be polished 6 held by the retainer ring 1. Between the polishing head 231 and the object to be polished 6, an insert pad 232 is placed.

The polishing machine 2 is configured so that, to the retainer ring 1, a load is applied by air cushion (not shown), and a pressure applied to the retainer ring 1 is adjustable, except for a press pressure of the object to be polished 6 applied to the polishing pad 21.

In such polishing machine 2, the retainer ring 1 holds the object to be polished 6, and the retainer ring 1 is mounted on the polishing head 231. The object to be polished 6 held by the retainer ring 1 is pressed against the polishing pad 21, and the polishing head 231 and the polishing table 22 are rotated, and the chemical is supplied from the nozzle 24. Accordingly, the object to be polished 6 is polished. In addition, in polishing, the first annular portion 11 of the retainer ring 1 is brought into a state of contact with the polishing pad 21, but the fixing portion 13 does not contact the polishing pad 21.

Next, operation and advantages of the present embodiment will be described.

The retainer ring 1 has the fixing portion 13 for fixing the first annular portion 11 and the second annular portion 12 provided therein. Then, the first annular portion 11 protrudes beyond the fixing portion 13 toward the opposite side of the second annular portion 12. That is, the surface of the first annular portion 11 on the polishing pad 21 side protrudes closer on the polishing pad 21 side than the surface of the fixing portion 13 on the polishing pad 21 side. Then, only the surface of the first annular portion 11 on the polishing pad 21 side can be made in contact with the polishing pad 21. Accordingly, a pressure is uniformly applied to the polishing pad 21 by the retainer ring 1, and the deformed area of the polishing pad 21 can be prevented from extending to the contact portion of the polishing pad 21 with the outer circumferential portion of the object to be polished 6. Thus, the object to be polished 6 can be uniformly polished.

Also, in the present embodiment, as described above, the fixing portion 13 does not contact the polishing pad 21 and only the first annular portion 11 contacts the polishing pad 21, and thereby a pressure can be uniformly applied to the polishing pad 21 by the retainer ring 1. Accordingly, the deformed area of the polishing pad 21 can be prevented from extending to the contact portion of the polishing pad 21 with the outer circumferential portion of the object to be polished 6.

Further, the fixing portion 13 is used to fix the first annular portion 11 and the second annular portion 12 with mechanical joining, and the adhesive does not corrode as conventionally, which can suppress deterioration of the retainer ring 1. Further, in recycling the retainer ring 1, it becomes unnecessary to remove the adhesive, and the retainer ring 1 can be easily recycled.

Moreover, in the present embodiment, the fixing portion 13 includes the male thread portion 131 provided in the outer circumferential portion of the first annular portion 11 and the female thread portion 132 provided in the outer circumferential portion of the second annular portion 12. Only screwing the male thread portion 131 and the female thread portion 132 together can fix the first annular portion 11 and the second annular portion 12, so that the retainer ring 1 can be easily assembled.

Further, the male thread portion 131 is integrally formed with the first annular portion 11, and the female thread portion 132 is integrally formed with the second annular portion 12, which can prevent an increase in the number of components for constituting the retainer ring 1.

Also, screwing the male thread portion 131 and the female thread portion 132 together can firmly fix the first annular portion 11 and the second annular portion 12.

Second Embodiment

Figure 4:
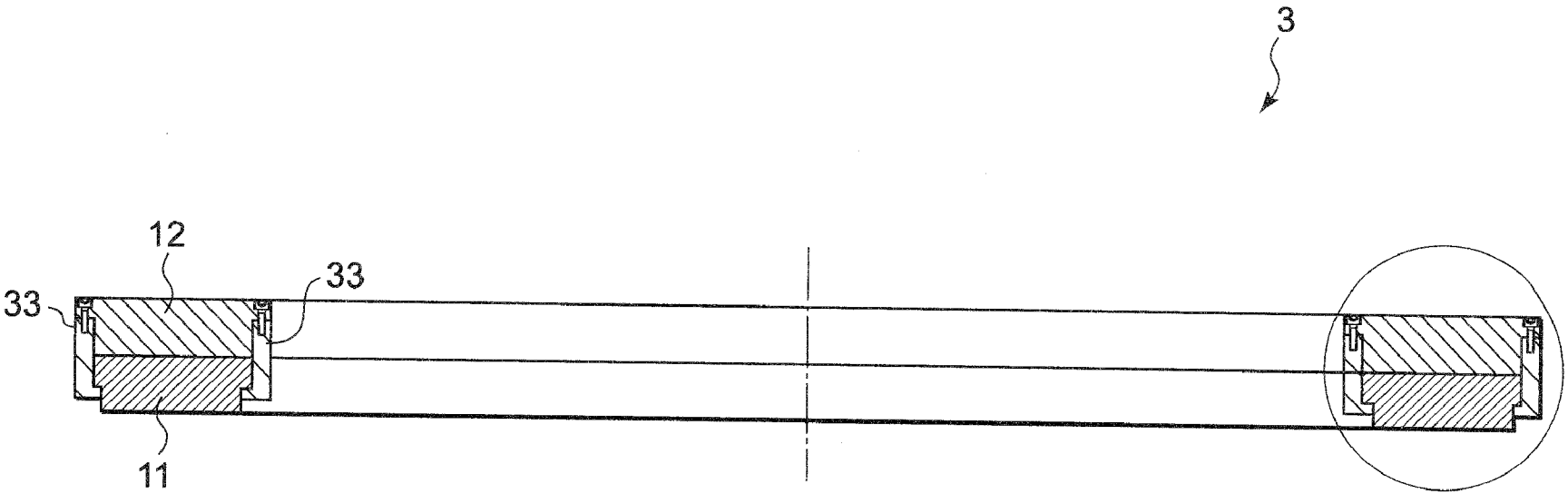
FIG. 4 is a cross-section view of a retainer ring according to a second embodiment of the present invention.
Figure 5:
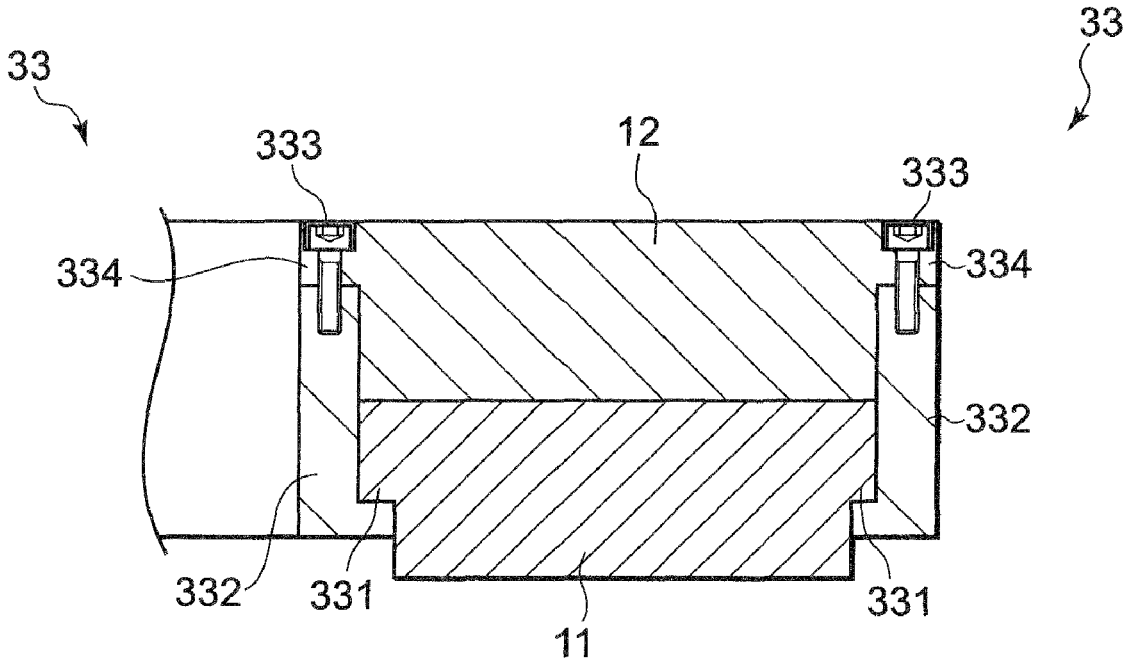
FIG. 5 is an enlarged cross-section view of a main portion of the retainer ring.
Figure 6:
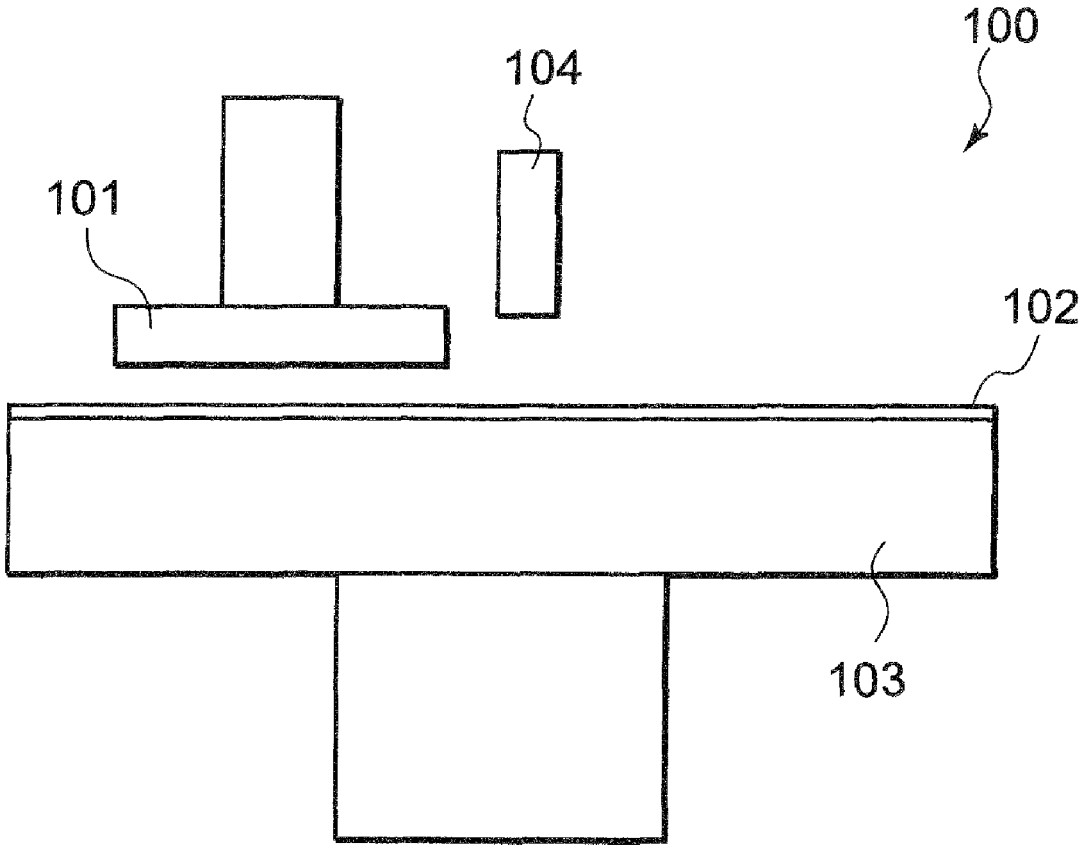
FIG. 6 is a schematic diagram illustrating a conventional polishing machine.
Figure 7:
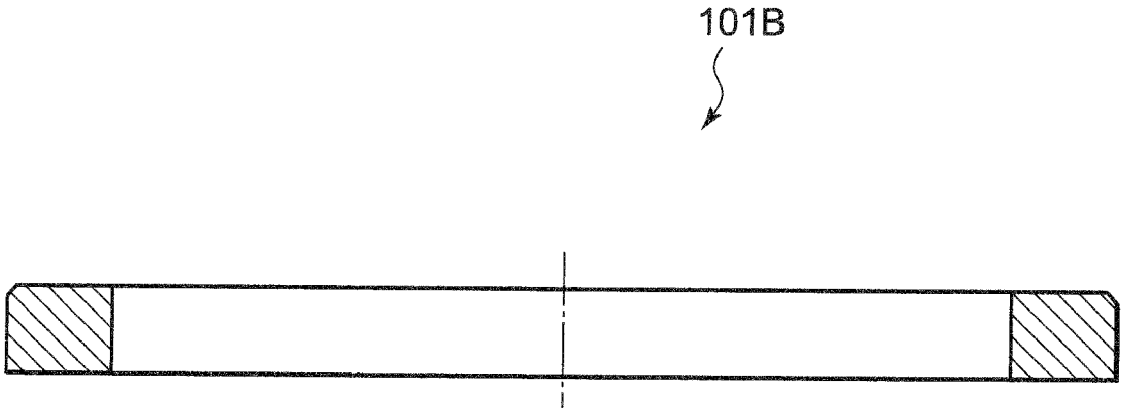
FIG. 7 is a cross-section view illustrating a conventional retainer ring.
Figure 8A:
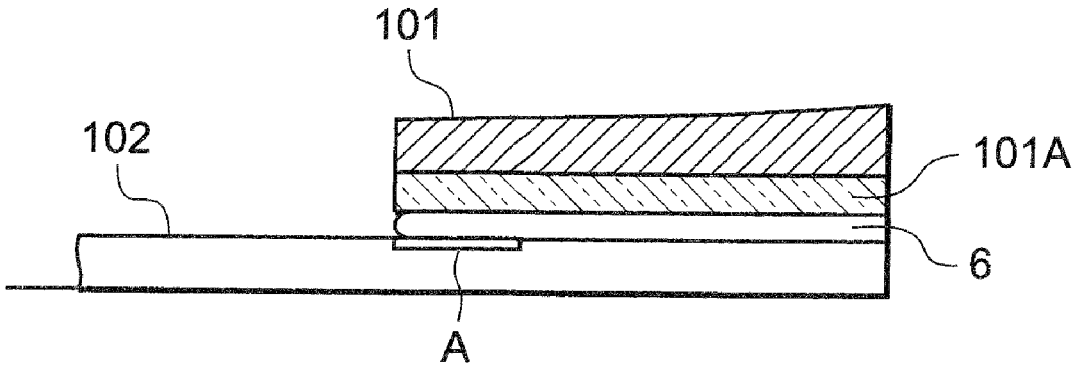
FIG. 8A shows a state that an object to be polished is polished in the conventional polishing machine.
Figure 8B:
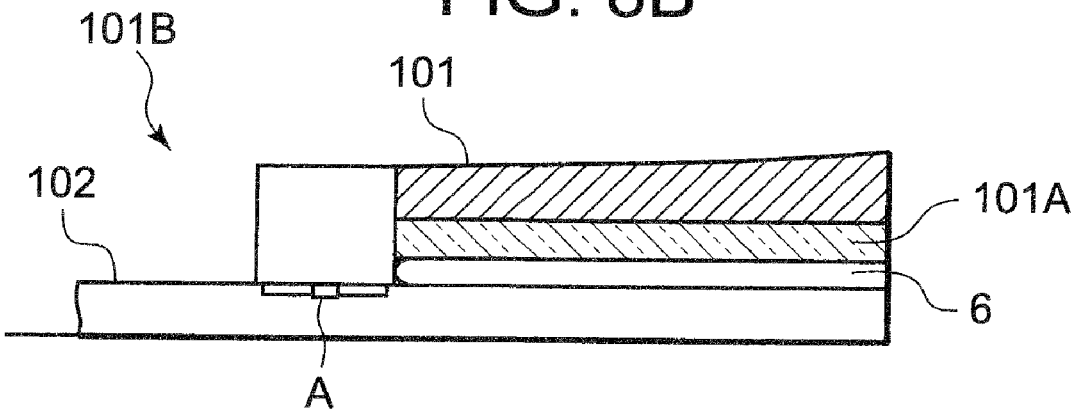
FIG. 8B shows a state that an object to be polished is polished in the conventional polishing machine using the retainer ring.
Figure 9:
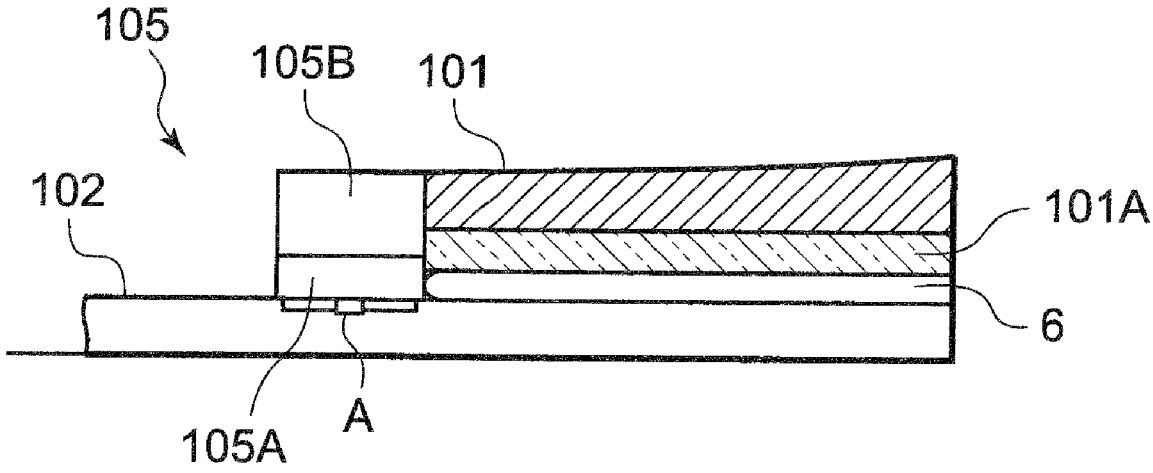
FIG. 9 shows a state that an object to be polished is polished in the conventional polishing machine using the retainer ring.
Figure 10:
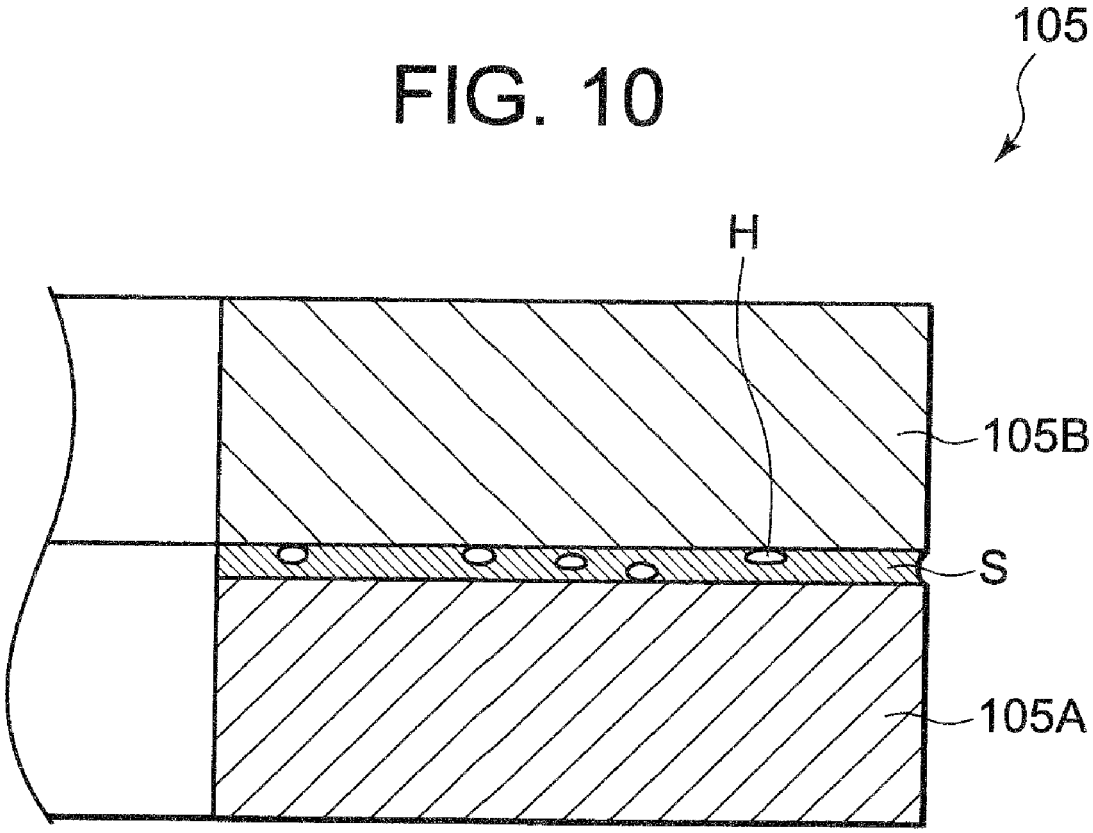
FIG. 10 is a cross-section view of a main portion of the conventional retainer ring.

Referring to FIGS. 4 and 5, a second embodiment will be described. FIG. 4 is a cross-section view of a retainer ring 3 of the present embodiment, and FIG. 5 is an enlarged view of a part surrounded by the circle in FIG. 4.

The present embodiment differs from the embodiment described above in a structure of the fixing portion. The other points are similar to the embodiment described above.

A fixing portion 33 of the retainer ring 3 of the present embodiment includes a projecting portion 331 protruding from a rim portion of a first annular portion 11, a support portion 332 with which the projecting portion 331 engages, and a projecting portion 334 and a coupling member 333 for connecting the support portion 332 to a second annular portion 12.

In addition, in the present embodiment, the fixing portion 33 is provided on an inner circumferential side and an outer circumferential side of the first annular portion 11 and the second annular portion 12, respectively.

The projecting portion 331 protrudes outward from an outer circumferential portion and an inner circumferential portion of the first annular portion 11, respectively. These projecting portions 331 are integrally formed with the first annular portion 11, and made of the same material as the first annular portion 11.

The support portion 332 is formed in an annular shape. The support portion 332 has a cross section having an approximate L-shape, and an end portion of the L-shape receives and supports the projecting portion 331. This support portion 332 can be made, for example, of the same material as the second annular portion 12. The support portion 332 is placed on the inner circumferential side and the outer circumferential side of the second annular portion 12, respectively. Further, a surface of the support portion 332 on the polishing pad 21 side draws away from a surface of the first annular portion 11 on the polishing pad 21 side. That is to say, the first annular portion 11 protrudes beyond the support portion 332 toward the opposite side of the second annular portion 12.

A object to be polished 6 is fitted into a step portion formed by a surface of such support portion 332 on the polishing pad 21 side and a portion of an inner surface of the first annular portion 11 protruding beyond the support portion 332 toward the polishing pad 21 side, and the object to be polished 6 is held by the retainer ring 3.

The projecting portion 334 protrudes outward from an upper end of an outer circumferential portion and an upper end of an inner circumferential portion of the second annular portion 12, respectively. The support portion 332 is placed under the projecting portion 334, and the projecting portion 334 and the support portion 332 are fixed with a screw that is the coupling member 333, and thereby the support portion 332 is connected to the second annular portion 12. Accordingly, the second annular portion 12 is fixed to the first annular portion 11 by the mechanical joining.

The present embodiment as described above can provide similar advantages to the first embodiment, and further provide the following advantages.

In the present embodiment, the fixing portion 33 is provided on the inner circumferential side and the outer circumferential side of the first annular portion 11 and the second annular portion 12, respectively. Accordingly, the fixing portion 33 can firmly fix the first annular portion 11 and the second annular portion 12.

Further, in the present embodiment, the object to be polished 6 does not necessarily have to be circular, and can have any shape such as a square shape.

In addition, the present invention is not limited to the embodiments described above, and changes and improvements in the range in which the object of the present invention can be achieved fall into the scope of the invention.

For example, in each embodiment described above, the second annular portion has been made of metal, but is not limited to this, and it may be any one having a mechanical strength higher than that of the first annular portion. For example, the second annular portion may be made of ceramics.

Also, in the first embodiment, the fixing portion 13 has included the male thread portion 131 provided in the first annular portion 11 and the female thread portion 132 provided in the second annular portion 12, but is not limited to this, the female thread portion may be provided in the first annular portion and the male thread portion may be provided in the second annular portion.

Further, the joining way of the fixing portion is not limited to the way shown in each embodiment described above, but it may be any mechanical joining. For example, by engagement, the first annular portion and the second annular portion may be connected to each other.

What is claimed is:

1. A retainer ring for holding an outer circumferential portion of an object to be polished, comprising:

a first annular portion for surrounding said outer circumferential portion of said object, said first annular portion having a first outer rim portion, a first inner rim portion, and an upper surface extending radially from the first inner rim portion to the first outer rim portion, and a second annular portion provided on said first upper surface of said first annular portion, said second annular portion having a second outer rim portion, a second inner rim portion, and a lower surface extending radially from the second inner rim portion to the second outer rim portion, wherein said second annular portion is fixed to said first annular portion by a mechanical joining, wherein an entirety of said upper surface of said first annular portion is in contact with said lower surface of said second annular portion, and wherein said mechanical joining includes a first thread provided in a surface of said first outer rim portion of said first annular portion, and a second projecting portion protruding from said second outer rim portion of said second annular portion and provided with a second thread configured to mate with said first thread.

2. A retainer ring for holding an outer circumferential portion of an object to be polished, comprising:

a first annular portion for surrounding said outer circumferential portion of said object, said first annular portion having a first outer rim portion, a first inner rim portion, and an upper surface extending radially from the first inner rim portion to the first outer rim portion, and a second annular portion provided on said first upper surface of said first annular portion, said second annular portion having a second outer rim portion, a second inner rim portion, and a lower surface extending radially from the second inner rim portion to the second outer rim portion;

a projecting portion protruding from one of said first outer rim portion and said first inner rim portion; and a support portion, having a first portion configured to engage with said projecting portion to support said first annular portion, and having a second portion fixed to said second annular portion with a mechanical fastener to fix said second annular portion to said first annular portion, and wherein an entirety of said upper surface of said first annular portion is in contact with said lower surface of said second annular portion.

3. The retainer ring according to claim 1, wherein said second annular portion has a mechanical strength higher than that of said first annular portion.

4. The retainer ring according to claim 1, wherein said first annular portion is made of a resin.

5. The retainer ring according to claim 1, wherein said second annular portion is made of a metal.

6. The retainer ring according to claim 1, wherein said second annular portion is made of a ceramic material.

7. A polishing machine, comprising:

a polishing pad for polishing an object; and a gripping portion for gripping said object and bringing said object into contact with said polishing pad, wherein said gripping portion has a retainer ring for holding an outer circumferential portion of said object, wherein said retainer ring includes a first annular portion for surrounding said outer circumferential portion of said object and for being brought into contact with said polishing pad, said first annular portion having a first outer rim portion, a first inner rim portion, an upper surface, and a second annular portion provided on said upper portion of said first annular portion, said second annular portion having a second outer rim portion, a second inner rim portion, a second inner rim portion, and a lower surface, wherein said second annular portion is fixed to said first annular portion by a mechanical joining, wherein an entirety of said upper surface of said first annular portion is in contact with said lower surface of said second annular portion, and wherein said mechanical joining includes a first thread provided in a surface of said first outer rim portion of said first annular portion, and a projecting portion protruding from said second outer rim portion of said second annular portion and provided with a second thread configured to mate with said first thread.

8. A polishing machine, comprising:

a polishing pad for polishing an object; and a gripping portion for gripping said object and bringing said object into contact with said polishing pad, wherein said gripping portion has a retainer ring for holding an outer circumferential portion of said object, wherein said retainer ring includes a first annular portion for surrounding said outer circumferential portion of said object and for being brought into contact with said polishing pad, said first annular portion having a first outer rim portion, a first inner rim portion, an upper surface, and a second annular portion provided on said upper portion of said first annular portion, said second annular portion having a second outer rim portion, a second inner rim portion, a second inner rim portion, and a lower surface, wherein said retaining ring also includes a projecting portion protruding from one of said first outer rim portion and said first inner rim portion, wherein said retaining ring further includes a support portion, having a first portion configured to engage with said projecting portion to support said first annular portion, and having a second portion fixed to said second annular portion with a mechanical fastener, wherein said second annular portion is fixed to said first annular portion by a mechanical joining, and wherein an entirety of said upper surface of said first annular portion is in contact with said lower surface of said second annular portion.

9. The polishing machine according to claim 7, wherein said second annular portion has a mechanical strength higher than that of said first annular portion.

10. The polishing machine according to claim 7, wherein said first annular portion is made of a resin.

11. The polishing machine according to claim 7, wherein said second annular portion is made of a metal.

12. The polishing machine according to claim 7, wherein said second annular portion is made of a ceramic material.

13. The polishing machine according to claim 7, wherein said polishing machine is a chemical mechanical polishing (OMP) apparatus, and wherein said polishing machine further includes a nozzle for supplying a slurry to said polishing pad.

14. The retainer ring according to claim 2, wherein the mechanical fastener is a screw.

15. The polishing machine according to claim 8, wherein the mechanical fastener is a screw.

16. The retainer ring according to claim 2, further comprising:

another projecting portion protruding from the other of said at least one of said first outer rim portion and said first inner rim portion; and another support portion, having a first portion configured to engage with said another projecting portion, and having a second portion fixed to said second annular portion with another mechanical fastener.

17. The polishing machine according to claim 8, wherein the retaining ring further includes another projecting portion protruding from the other of said at least one of said first outer rim portion and said first inner rim portion, and another support portion, having a first portion configured to engage with said another projecting portion, and having a second portion fixed to said second annular portion with another mechanical fastener.

* * * * *